US007214306B1

(12) United States Patent
Ferrando

(10) Patent No.: US 7,214,306 B1
(45) Date of Patent: May 8, 2007

(54) ELEVATED POTENTIAL DEPOSITION OF RHENIUM ON GRAPHITE SUBSTRATES FROM A $REO_2/H_2O_2$ SOLUTION

(75) Inventor: William A. Ferrando, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1 day.

(21) Appl. No.: 11/108,406

(22) Filed: Apr. 18, 2005

Related U.S. Application Data

(60) Provisional application No. 60/563,191, filed on Apr. 16, 2004.

(51) Int. Cl.
*C25D 3/54* (2006.01)

(52) U.S. Cl. ..... 205/262

(58) Field of Classification Search ..... 205/262
See application file for complete search history.

(56) References Cited

U.S. PATENT DOCUMENTS 2,863,083 A * 12/1958 Schram ..... 378/121
3,285,839 A * 11/1966 Camp ..... 205/262
3,819,971 A 6/1974 Kaplan et al.
3,901,663 A 8/1975 Hofmann et al.
3,982,148 A 9/1976 Kaplan et al.
4,196,230 A 4/1980 Gibson et al.
4,917,968 A 4/1990 Tuffias et al.
5,352,489 A 10/1994 Ohara et al.
5,577,263 A 11/1996 West
5,855,828 A 1/1999 Tuffias et al.
5,874,015 A 2/1999 Mittendorf et al.
5,875,228 A 2/1999 Truszkowska
5,935,351 A 8/1999 Sherman et al.
6,150,300 A 11/2000 Khare et al.

OTHER PUBLICATIONS

Boland et al., "Electrodeposition of Refractory Metals From Molten Salts", Proceedings—Electrochemical Society (no month, 2002), 2002-19 (Molten Salts XIII), pp. 797-802.*
Sayre, "Application of Rhenium and Rhenium Containing Alloys", The Minerals, Metals & Materials Society (no month, 1994), pp. 191-200.*
U.S. Appl. No. 10/394,233, filed Mar. 24, 2003, Divecha, et al.

* cited by examiner

*Primary Examiner*—Edna Wong
(74) *Attorney, Agent, or Firm*—Jane Barrow; Jacob Shuster

(57) ABSTRACT

A method of depositing rhenium onto a substrate comprising dissolving rhenium oxide in a hydrogen peroxide solution, immersing a negative and a positive electrode into the solution, immersing a substrate to be coated with rhenium into the solution next to the negative electrode or, alternatively, using the substrate to be coated as the negative electrode, and applying a current between the two electrodes.

6 Claims, 5 Drawing Sheets

SCHEMATIC ILLUSTRATION OF "NOZZLE" PLATING ARRANGEMENT IN $ReO_2$ / $H_2O_2$ SOLUTION.

FIG. 1

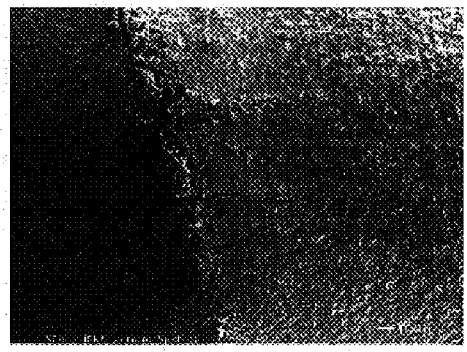

Title: MPD Graphite Rod B-3 Date: 02-10-2003 Time 10:59
Comment: 50x Filename: MPD-B3.TIF SEM of Immersed Area of Negative Graphite Rod After Current Application (Case 1)

FIG. 2

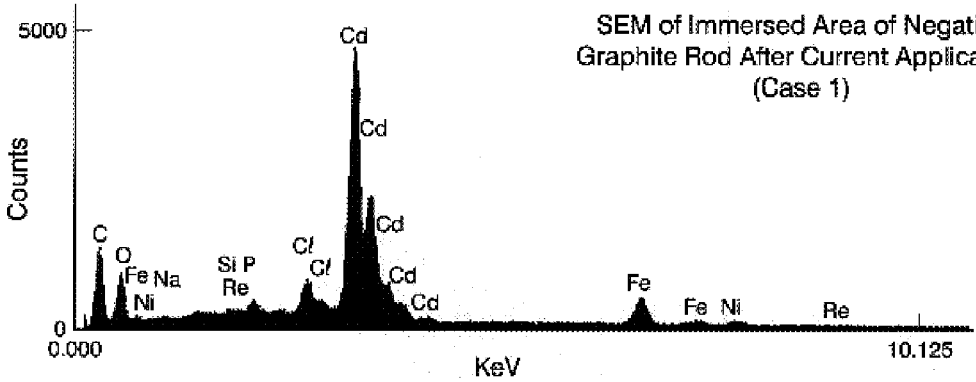

HPD GRAPHITE ROD B-2 BRIGHT AREA 200x

ACCELERATING VOLTAGE: 15 KeV TAKE OFF ANGLE: 37.5436°

LIVE TIME: 100 SECONDS DEAD TIME: 42.668

QUANTITATIVE ANALYSIS

MON FEB 10 10:36:29 2003

HPD GRAPHITE ROD B-2 BRIGHT AREA, 200x

| ELEMENT | k-RATIO (CALC.) | ZAF | ATOM (%) | ELEMENT WT (%) | WT % ERR. (1-SIGMA) |
|---|---|---|---|---|---|
| Si-K | 0.0091 | 1.359 | 2.33 | 1.24 | +/- 0.21 |
| P-K | 0.0386 | 1.338 | 8.83 | 5.17 | +/- 0.30 |
| Cl-K | 0.1275 | 1.149 | 21.88 | 14.66 | +/- 0.61 |
| Fe-K | 0.5357 | 0.990 | 50.24 | 53.03 | +/- 1.95 |
| Ni-K | 0.1481 | 1.023 | 13.56 | 15.16 | +/- 2.49 |
| Re-L | 0.0750 | 1.432 | 3.05 | 10.75 | +/- 6.91 |
| TOTAL | | | 100.00 | 100.00 | |

EDAX SCAN OF BRIGHT AREA SHOWN IN FIGURE 1.

FIG. 3

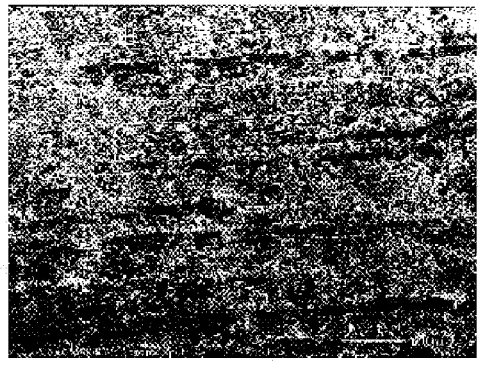

Title: Carbon Rod; Negative; L Date: 02-25-2003 Time 13:58
Comment: 200x Filename: NEG-L.TIF Typical Portion of Negative Rod Surface from below Electrolyte after Application of Current (Case 2).

FIG. 4

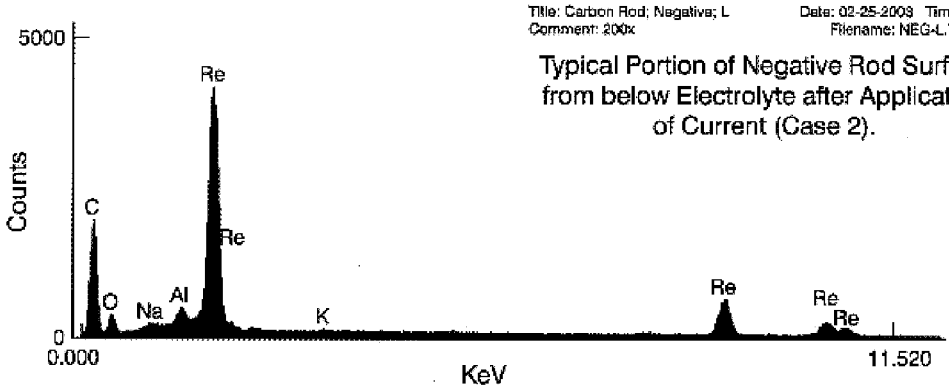

CARBON ROD, NEGATIVE, BRIGHT G 5000x

ACCELERATING VOLTAGE: 15 KeV TAKE OFF ANGLE: 38.793°
LIVE TIME: 100 SECONDS DEAD TIME: 37.666

QUANTITATIVE ANALYSIS
TUE FEB 25 11:28:22 2003
CARBON ROD, NEGATIVE, BRIGHT G, 5000x

| ELEMENT | k-RATIO (CALC.) | ZAF | ATOM (%) | ELEMENT WT (%) | WT % ERR. (1-SIGMA) | NO. OF CATIONS |
|---|---|---|---|---|---|---|
| C-K | 0.0711 | 3.422 | 76.29 | 24.33 | +/- 0.24 | 199.265 |
| O-K | 0.0102 | 3.814 | 9.19 | 3.90 | +/- 0.10 | - |
| Al-K | 0.0000 | 1.073 | 0.00 | 0.00 | +/- 0.00 | 0.000 |
| Re-L | 0.5743 | 1.250 | 14.52 | 71.77 | +/- 1.93 | 37.915 |
| TOTAL | | | 100.00 | 100.00 | | 237.181 |

EDAX SCAN OF TYPICAL BRIGHT AREA OF IMMERSED NEGATIVE ELECTRODE AFTER CURRENT APPLICATION.

CARBON ROD, NEGATIVE, DARK H, 5000x

ACCELERATING VOLTAGE: 15 KeV TAKE OFF ANGLE: 38.793°

LIVE TIME: 100 SECONDS DEAD TIME: 22.128

QUANTITATIVE ANALYSIS

TUE FEB 25 11:35:55 2003

CARBON ROD, NEGATIVE, DARK H, 5000x

| ELEMENT | k-RATIO (CALC.) | ZAF | ATOM (%) | ELEMENT WT (%) | WT % ERR. (1-SIGMA) | NO. OF CATIONS |
|---|---|---|---|---|---|---|
| C-K | 0.4786 | 1.662 | 93.82 | 79.57 | +/- 0.41 | 445.711 |
| O-K | 0.0095 | 6.004 | 5.05 | 5.71 | +/- 0.39 | - |
| Al-K | 0.0002 | 1.308 | 0.01 | 0.00 | +/- 0.02 | 0.061 |
| Re-L | 0.0810 | 1.815 | 1.12 | 14.70 | +/- 1.68 | 5.311 |
| TOTAL | | | 100.00 | 100.00 | | 451.083 |

EDAX SCAN OF TYPICAL DARK AREA OF NEGATIVE ELECTRODE AFTER CURRENT APPLICATION.

FIG. 6

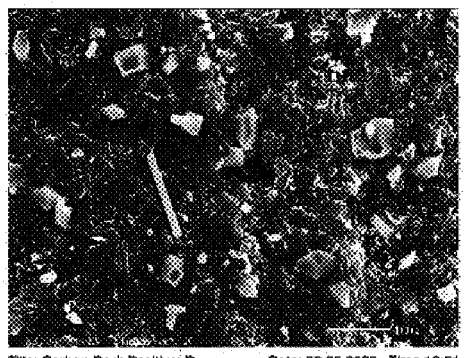

Title: Carbon Rod; Positive; D
Comment: 2000x
Date: 02-25-2003 Time 13:51
Filename: POS-D.TIF SEM Photograph of Positive Electrode Surface After Current Application Showing Nodular Morphology.

FIG. 7

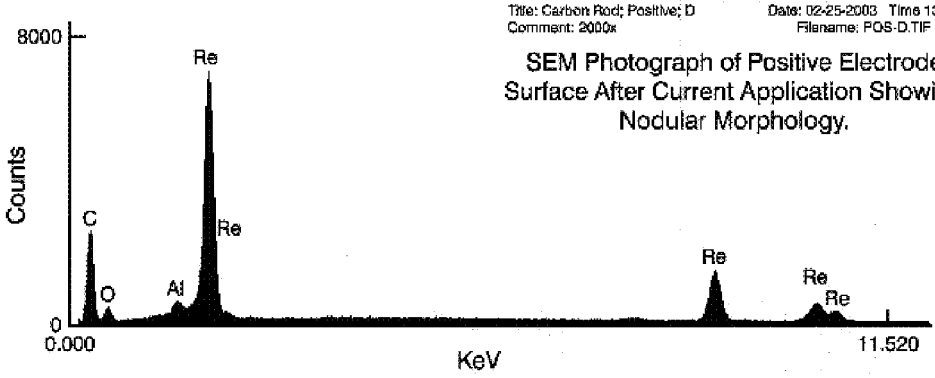

CARBON ROD, POSITIVE, PARTICLE F 200Kx

ACCELERATING VOLTAGE: 15 KeV
TAKE OFF ANGLE: 38.793°
LIVE TIME: 100 SECONDS
DEAD TIME: 58.044

QUANTITATIVE ANALYSIS
TUE FEB 25 11:17:02 2003
CARBON ROD, POSITIVE, PARTICLE F, 200Kx

| ELEMENT | k-RATIO (CALC.) | ZAF | ATOM (%) | ELEMENT WT (%) | WT % ERR (1-SIGMA) | NO. OF CATIONS |
|---|---|---|---|---|---|---|
| C-K | 0.0488 | 3.547 | 71.17 | 17.31 | +/- 0.16 | 226.386 |
| O-K | 0.0068 | 3.580 | 7.55 | 2.44 | +/- 0.11 | - |
| Al-K | 0.0000 | 1.043 | 0.00 | 0.00 | +/- 0.00 | 0.000 |
| Re-L | 0.6854 | 1.171 | 21.28 | 80.24 | +/- 1.37 | 67.691 |
| TOTAL | | | 100.00 | 100.00 | | 294.077 |

EDAX SCAN OF TYPICAL BRIGHT PARTICLE ON POSITIVE ELECTRODE AFTER APPLICATION OF CURRENT.

SCHEMATIC ILLUSTRATION OF "NOZZLE" PLATING ARRANGEMENT IN $ReO_2$ / $H_2O_2$ SOLUTION.

ELEVATED POTENTIAL DEPOSITION OF RHENIUM ON GRAPHITE SUBSTRATES FROM A $REO_2/H_2O_2$ SOLUTION

PRIORITY CLAIM

The present application claims priority from U.S. Provisional Application No. 60/563,191 filed on Apr. 16, 2004, by William A. Ferrando, entitled "Elevated Potential Deposition of Rhenium on Graphite Substrates from a $ReO_2/H_2O_2$ Solution," the entire contents of which are incorporated herein by reference.

STATEMENT OF GOVERNMENT INTEREST

The invention described herein may be manufactured and used by or for the Government of the United States of America for governmental purposes without the payment of any royalties thereon or therefore.

BACKGROUND

1. Field of the Invention

The present invention relates to rhenium coatings, and, more specifically, to deposition of rhenium on graphite and carbon—carbon composites.

2. Description of the Prior Art

Rhenium melts at a temperature of about 3200° C. and is quite oxidation resistant. These properties are required for survival in certain very demanding environments, such as in rocket nozzle applications. Fabrication of these components is currently accomplished using bulk rhenium, which is specially prepared, formed, and machined. The cost of producing such components in this manner is very high.

SUMMARY

The aforementioned problems with the current technologies are overcome by the present invention wherein rhenium is deposited onto a substrate by dissolving rhenium oxide in a hydrogen peroxide solution, immersing a negative and a positive electrode into the solution, immersing a substrate to be coated with rhenium into the solution next to the negative electrode or, alternatively, using the substrate to be coated as the negative electrode, and applying a current between the two electrodes.

The present invention provides several advantages over the prior art. The deposition of the present invention is simple. Rhenium is deposited in a single step, without high temperature reduction from a compound or the use of elaborate equipment or other complications. The only equipment required is a dc power supply capable of delivering several amperes at about 40 volts, a concentrated hydrogen peroxide solution bath containing an appropriate quantity of dissolved $ReO_2$, a suitable component holding apparatus, graphite shapes upon which the rhenium is to be deposited, and, perhaps, a means of continuously replenishing the electrolyte concentration during the deposition process.

BRIEF DESCRIPTION OF THE DRAWINGS

These and other features and advantages of the invention, as well as the invention itself, will become better understood by reference to the following detailed description, appended claims, and accompanying drawings where:

FIG. 1 is a SEM of immersed area of negative graphite rod after current application;

FIG. 2 is an EDAX scan of bright area shown in FIG. 1;

FIG. 3 shows a typical portion of negative rod surface from below electrolyte after application of current;

FIG. 4 is an EDAX scan of typical bright area of immersed negative electrode after current application;

FIG. 6 is a SEM photograph of positive electrode surface after current application showing nodular morphology;

FIG. 7 is an EDAX scan of typical bright particle on positive electrode after application of current.

DETAILED DESCRIPTION

Figure 5:
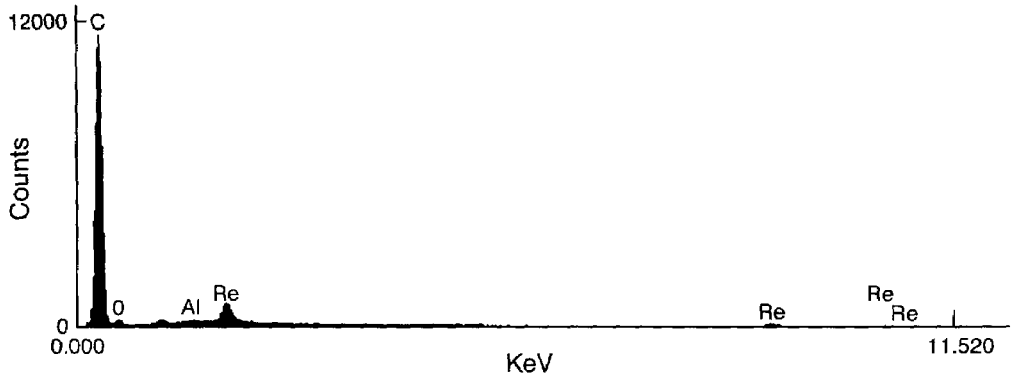
FIG. 5 is an EDAX scan of typical dark area of negative electrode after current application.

In a preferred embodiment, rhenium oxide is dissolved in a hydrogen peroxide solution, a negative electrode and a positive electrode are immersed in the solution, a substrate to be coated with rhenium is immersed in the solution next to the negative electrode, and a current is applied between the two electrodes.

For the solution, 0.5 g of $ReO_2$ was dissolved in 30 ml of 30% $H_2O_2$ in experimentation. However, these quantities were based on a small quantity of $ReO_2$ available for experimentation. A more concentrated solution of $ReO_2$, up to the limit of solubility, would probably perform better. Moreover, using a higher percentage of hydrogen peroxide, e.g., a 50% $H_2O_2$ solution, would dissolve even more $ReO_2$ and may perform better.

In a preferred embodiment, the negative and positive electrodes each comprise graphite or a carbon—carbon composite. In experimentation, graphite rods were used as the electrodes, and the negative electrode was the substrate to be coated.

In a further preferred embodiment, the substrate to be coated comprises graphite or a carbon—carbon composite. Moreover, the substrate to be coated may be used as the negative electrode.

In an even more preferred embodiment, the current has an initial potential of at least 15 volts. A dc power supply can be used to supply the current, which reduces the rhenium oxide. There should be no other metal ions besides rhenium in the solution.

Experiment 1

Rhenium oxide is soluble in $H_2O_2$ and $HNO_3$. To help insure deposition of only the rhenium species, a graphite rod was used for both positive and negative electrodes. A preliminary trial showed that the concentrated $HNO_3$ solution dissolved the negative graphite rod after several hours of applied current. A solution of 30 ml $H_2O_2$ with 0.5 g $ReO_2$ was prepared in a small beaker. A dc current of about 100 ma was established between two HPD graphite rods after immersing one end of each in the solution. Metal clip contact was made to each graphite rod above the solution to the power supply. A current of about 100 ma (equivalent to about 20 ma/cm2) was applied for about 48 hours. This current was chosen to prevent excessive gassing/misting of the solution. Even so, after several hours, evident dissolution of the negative clip was observed. An initial potential of about 30 volts was noted. This decreased over the course to the experiment to below 10 volts at the end. The graphite rods then were removed and rinsed with water and propanol. FIG. 1 shows a portion of the negative graphite rod, which had been immersed in the solution (bright area).

FIG. 2 is an EDAX scan of a typical bright area immersed portion of the negative electrode of FIG. 1. This clearly indicates the presence of numerous elements in the bright area coating, including principally cadmium and iron. According to the statistical analysis, rhenium comprised about 10-wt % of the coating, but the peaks were lost in the scaling to the other elements. It was determined that the electrolyte solution misted above its surface, wetting and slowly dissolving the contact clip. This action introduced the "impurity" elements, which were deposited along with the Re. Since a pure Re coating is desired, the experimental setup was modified to preclude dissolution of the clips.

Experiment 2

A small beaker was provided with a tight-fitting polyethylene top, through which holes were drilled and two 3-inch long 3/16-inch diameter HPD graphite rods were pressed through to the bottom of the beaker. This was filled with a solution of about 15 ml of 30% $H_2O_2$ with 0.5 g $ReO_2$. The immersed length of the rods again was about 1.25 inches. A current of about 50 ma (equivalent to about 10 ma/cm$^2$) was applied for about 2 days. An initial potential of 25.6 volts was noted. This decreased to 20.8 V after ten minutes, to 12.9 V after 45 minutes, to 7.4 V after 8 hours, finally reaching about 6.1 V by the end of the 2-day period. No solution was observed to escape from the beaker and no dissolution of the clips was detected. The rods were removed and rinsed. SEM photographs and EDAX scans were taken. FIG. 3 shows a typical portion of the negative electrode from beneath the electrolyte surface, after the period of current application.

FIGS. 4 and 5 present EDAX scans of typical bright and dark regions of FIG. 3, respectively. The accompanying analyses indicate the presence of rhenium in both the bright and dark regions, with virtually on contamination by other metallic species. Analysis of the bright area scan indicates an elemental fraction of about 71 we % Re, while the dark region scan indicates about 15% of elemental Re. The presence of such a small quantity of oxygen (~4 to 6 we %) confirms that the Re detected was likely in its pure metallic form. If simply residual $ReO_2$ were present, the weight fraction of oxygen to rhenium would need to be at least 32/186.2~0.172. Then at least 12.2% oxygen would need to accompany the 71 wt % Re, rather than the 3.9% indicated in the scan analysis. A scan of the rod portion from above the liquid level showed only a trace quantity of Re. The Depth of probe (integration depth) of the EDAX beam depends upon the accelerating voltage and the density of the material being scanned. Typical depths of probe at the machine settings used here vary from about 7 microns for polymers down to <0.5 micron for gold. In the present case, therefore, the coating thickness probably was of the order of one micron.

Some rhenium deposition apparently also occurred at the positive electrode, in a rather nodular form. FIG. 6 shows a portion of the positive rod, containing the apparent Re particles. FIG. 7 is a scan limited to one of the particles. This scan analysis confirmed a content of some 80 wt % Re in the particle, again with very low oxygen (about 2.5 wt %). Re (~34 we %), also with low oxygen, also was detected by scans between the particles.

Figure 8:
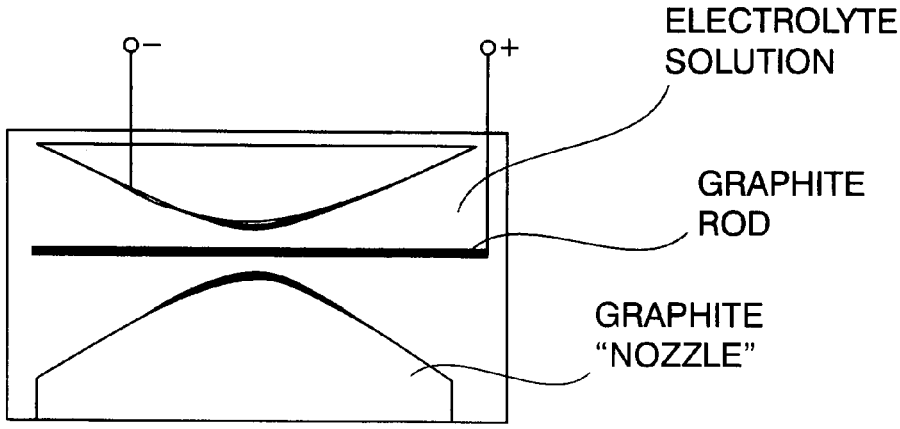
FIG. 8 is a schematic illustration of a "nozzle" plating arrangement in $ReO_2/H_2O_2$ solution.

Plating in the cases discussed above took place on the immersed portion of the outside graphite rod cylindrical surface. The inside surface of a "nozzle-like" component could be coated fairly easily, simply by providing the appropriate electrode geometry. (See FIG. 8). The nozzle shape is immersed in a $ReO_2$ solution, as described above. A graphite rod is placed concentrically through its opening. Electrical connection to is made to each by insulated wires, the rod positive and nozzle shape negative. A potential is applied across the electrodes, sufficient to produce the desired current density. Rhenium deposition will occur on the inner diameter of the shape. Somewhat preferential deposition should occur on the nozzle surface in the higher field region nearest the rod. Illustration of this has been attempted in FIG. 8. By shaping the center electrode appropriately, some tailoring the deposition thickness should be possible.

The various rhenium chloride compounds might be used in alternative solutions; however, these compounds are generally identified as soluble in HCl or $HNO_3$ only. These acid-based solutions gave negative results when they were tested with $ReO_2$. In particular, the $HNO_3$ based solution quite rapidly dissolved the negative graphite rod upon application of the current. It may be, therefore, unlikely that these highly acidic solutions would be any more successful with the chloride compounds.

The above description is that of a preferred embodiment of the invention. Various modifications and variations are possible in light of the above teachings. It is therefore to be understood that, within the scope of the appended claims, the invention may be practiced otherwise than as specifically described. Any reference to claim elements in the singular, e.g., using the articles "a," "an," "the," or "said" is not construed as limiting the element to the singular.

What is claimed is:

1. A method of depositing rhenium onto a substrate, comprising:

a. dissolving rhenium oxide in a hydrogen peroxide solution;

b. immersing a negative and a positive electrode into the solution;

c. immersing a substrate to be coated with rhenium into the solution next to the negative electrode or, alternatively, using the substrate to be coated as the negative electrode; and d. applying a current between the two electrodes.

2. The method of claim 1, wherein said substrate comprises graphite or a carbon—carbon composite.

3. The method of claim 1, wherein each of said electrodes comprises graphite or a carbon—carbon composite.

4. The method of claim 1, wherein the applied current has an initial potential of at least 15 volts.

5. The method of claim 1, wherein the solution contains no metal ions except rhenium.

6. The method of claim 1, wherein the current is applied for about 48 hours.

* * * * *